US010315888B2

(12) United States Patent
Su

(10) Patent No.: US 10,315,888 B2
(45) Date of Patent: Jun. 11, 2019

(54) FIREFLY TYPE END COVER

(71) Applicant: Otis Elevator Company, Farmington, CT (US)

(72) Inventor: Yanna Su, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/024,929

(22) PCT Filed: Sep. 25, 2013

(86) PCT No.: PCT/CN2013/084169
§ 371 (c)(1),
(2) Date: Mar. 25, 2016

(87) PCT Pub. No.: WO2015/042792
PCT Pub. Date: Apr. 2, 2015

(65) Prior Publication Data

US 2016/0229669 A1 Aug. 11, 2016

(51) Int. Cl.
*B66B 23/00* (2006.01)
*B66B 21/00* (2006.01)
(Continued)

(52) U.S. Cl.
CPC ..... *B66B 29/00* (2013.01); *B66B 23/00* (2013.01); *B66B 29/02* (2013.01); *B66B 31/00* (2013.01)

(58) Field of Classification Search
None
See application file for complete search history.

(56) References Cited

U.S. PATENT DOCUMENTS 6,173,517 B1 * 1/2001 Eibner ..... G02B 6/0001 362/240
7,080,741 B1 * 7/2006 Butzin ..... B07B 1/24 209/293
(Continued)

FOREIGN PATENT DOCUMENTS

CN 1740075 A 3/2006
CN 2841603 Y 11/2006
(Continued)

OTHER PUBLICATIONS

International Search Report for application PCT/CN2013/084169, dated May 9, 2014, 2 pages.
(Continued)

*Primary Examiner* — Kavel Singh
(74) *Attorney, Agent, or Firm* — Cantor Colburn LLP

(57) ABSTRACT

The application discloses an end cover (30,40) of an anti-clamping device for an apron board, which includes a body (32,42) made of a transparent material or a translucent material; one or multiple LED lighting lamp(s) (36) is(are) provided in the interior of the body; and a coupling member formed on at least a part of the body (32,42), which cooperates with at least a part of the anti-clamping device to form a detachable connection between the body and the anti-clamping device, and the size from a first end of the body (32,42) to a second end thereof is gradually reduced so as to form a smooth transition between the apron board and the anti-clamping device. Providing the end cover reduces the clearance between a step and the apron board, provides enhanced lighting effect in the vicinity of a boundary from a comb to the step, reduces the cost of installation and maintenance, and does not reduce the strength of the apron board.

11 Claims, 5 Drawing Sheets

(51) Int. Cl.

| | |
|---|---|
| ***B66B 29/00*** | (2006.01) |
| ***B66B 31/00*** | (2006.01) |
| ***B66B 29/02*** | (2006.01) |

(56) References Cited

U.S. PATENT DOCUMENTS

| | | | | |
|---|---|---|---|---|
| 7,080,921 | B2 * | 7/2006 | Feldstein | B66B 23/225 362/219 |
| 7,374,319 | B2 * | 5/2008 | Camarota | A47K 3/003 16/110.1 |
| 2009/0057097 | A1 | 3/2009 | Matheisl et al. | |

FOREIGN PATENT DOCUMENTS

| | | | |
|---|---|---|---|
| CN | 101224846 | A | 7/2008 |
| CN | 201176354 | Y | 1/2009 |
| EP | 0888996 | A1 | 1/1999 |
| JP | H07149490 | A | 6/1995 |
| JP | 2000128469 | A | 5/2000 |
| JP | 2004051294 | A | 2/2004 |
| KR | 100645094 | B1 | 11/2006 |

OTHER PUBLICATIONS

Chinese Office Action and Search Report for application CN 201380079815.7, dated Feb. 28, 2017, 13pgs.
European Search Report for application EP 13894872.4, dated Jul. 13, 2017, 7pgs.

* cited by examiner

FIREFLY TYPE END COVER

TECHNICAL FIELD

The present disclosure generally relates to an escalator or travelator system, and more particularly, to an end cover of an anti-clamping device for an apron board used for an escalator or a travelator.

BACKGROUND ART

An anti-clamping device for an apron board is widely used in an apparatus such as an escalator or a travelator for safety protection, in order to prevent the object carried by the user or a part of the body thereof from being caught between the escalator or the travelator and its bezel. For example, in the China National Standard GB 16899-2011 issued and carried out on Jul. 29, 2011 ("Safety Code for Construction and Installation of Escalators and Travelators"), mandatory requirements are clearly set forth for the aforementioned anti-clamping device for an apron board. For example, in the drawings (partially shown in FIG. 1 of the present disclosure, taking millimeter as the unit) in Section 5.5.3.4 of this Standard, specific sizes of the anti-clamping device for an apron board (for example, including an apron board brush) are limited. For example, a flexible member 1 and a rigid member 2 of the anti-clamping device for an apron board should meet a certain size relationship and scale requirement, and should meet a certain cooperating relationship with a step 3 of the escalator.

In the above Standard GB 16899-2011, a rear end part of the anti-clamping device for an apron board (also referred to an "end cap") is further limited. For example, it is clearly disclosed on Page 20 of the text of this Standard "the rear end part of the anti-clamping device for an apron board should be gradually reduced and connected with the apron board smoothly. The endpoint of the anti-clamping device for an apron board should be located at a position greater than 50 mm and smaller than 150 mm in front of an intersection line between a comb and a tread (the step side)." FIG. 2 illustratively shows a schematic view of an anti-clamping device 14 for an apron board including an end cover 12 in the prior art. It can be viewed from the figure that, the end cover may be installed on one end of the anti-clamping device for an apron board, as a transition between the anti-clamping device for an apron board and the apron board.

However, in the case of improper installation, there may be a large clearance between the step and the apron board and the anti-clamping device for an apron board, which still has a risk in safety.

On the other hand, there are also requirements on lighting the escalator or travelator in this field. Out of consideration for personal and property safety, many countries generally require for setting necessary lighting devices around the escalator or travelator system or on the system. For example, in the existing technical configuration shown in FIG. 3, a comb lamp 26 is disposed at a position near the boundary between the comb 24 and the step 22 (i.e., the tread) to illuminate the boundary, so as to attract the attention of users, and to avoid accidents.

However, during lighting through a comb lamp, a hole needs to be drilled for example on the apron board for installing the comb lamp, which at least leads to the problems in many aspects: first, it is difficult to drill holes on the apron board of an older escalator or travelator, the workload is increased, and the cost of installation and maintenance is increased; second, drilling may also reduce the overall strength of the apron board and the escalator system, resulting in a potential safety risk; third, the comb lamp also needs to meet the requirements in standards or laws, thereby reducing the interchangeability and further increasing the cost.

In addition, in the poor lighting conditions, it is further expected to enhance the lighting effect of the comb lamp. For example, when it is required to achieve a higher lighting level such as 50 lux or higher on the boundary between the comb and the step during the stair measurement, the existing lighting devices are expected to be enhanced and improved.

Therefore, in this field, there are requirements on an improvement to the safety and lighting function of the escalator or travelator at a low cost, and in addition, in this field, there are further requirements on simply and conveniently adding a fixed lighting source in the comb region during the rehabilitation operations.

SUMMARY OF THE INVENTION

In order to enhance the safety and lighting function of escalators or travelators by means of a convenient installation manner at a low cost, the present application provides an end cover having a further safety protection and lighting effect, which can be used in cooperation with a standard apron board protection device in the existing technology or the non-existing technology.

According to a first aspect, an end cover of an anti-clamping device for an apron board is provided, which includes a body made of a transparent material or a translucent material; one or multiple LED lighting lamp(s) is(are) provided in the interior of the body; and a coupling member formed on at least a part of the body, which cooperates with at least a part of the anti-clamping device to form a detachable connection between the body and the anti-clamping device. As for the composing parts of the end cover, the size from a first end of the body to a second end thereof is gradually reduced so as to form a smooth transition between the apron board and the anti-clamping device.

According to a second aspect, an escalator system is provided, which includes the end cover of an anti-clamping device for an apron board according to the first aspect.

According to a third aspect, a travelator system is provided, which includes the end cover of an anti-clamping device for an apron board according to the first aspect.

The escalator system or travelator system employing the end cover according to the present application can reduce the clearance between the step and the apron board and prevent objects or uses' bodies from being caught therein. In addition, by using the above end cover and the escalator system or travelator system having the end cover, the present application, independent of or attaching to the comb lamp, provides an enhanced lighting effect in the vicinity of the boundary from the comb to the step and increases the safety in use. In addition, as compared with the comb lamp to be added by drilling holes, the present application only needs to replace the end cover for the existing escalator system or travelator system, thereby reducing the cost rather than decreasing the strength of the apron board.

DESCRIPTION OF THE DRAWINGS

These and other features, aspects, and advantages of the present application can be better understood by reading the following detailed description with reference to the accompanying drawings, and in all the accompanying drawings, similar reference numerals indicate similar parts. In the figures.

DETAILED DESCRIPTION OF THE EMBODIMENTS

To describe the objectives, technical solutions, and advantages of the present invention more clearly, the following makes a further detailed description on the present invention with reference to the accompanying drawings and specific embodiments.

For simplicity, some technical features that are well-known to persons skilled in the art are omitted in the following description.

Figure 4A:
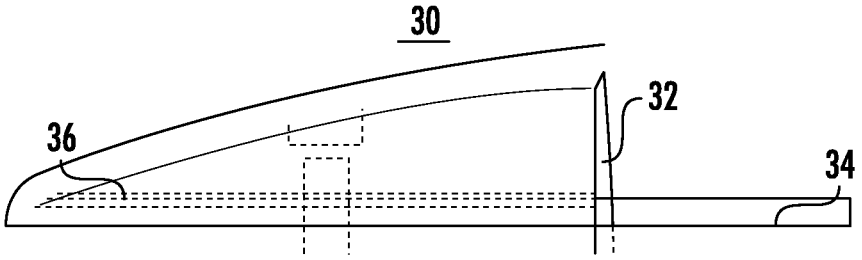
FIGS. 4A-4B are schematic views of the end cover for an anti-clamping device for an apron board configured in a single row according to an embodiment of the present disclosure.
Figure 4B:
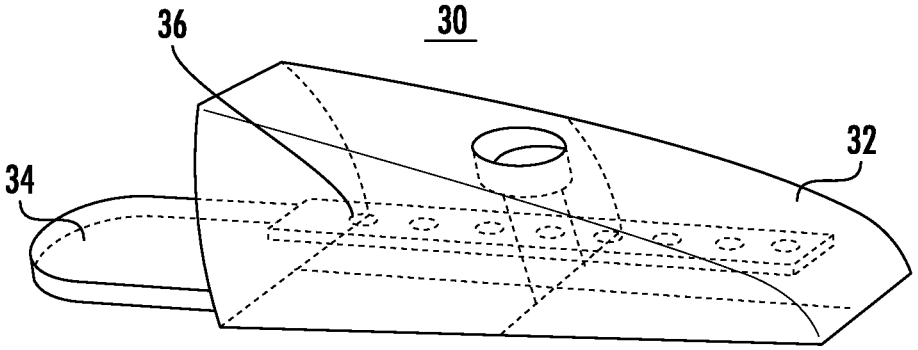

FIGS. 4A-4B are a front view and a stereogram respectively illustratively show the end cover 30 for an anti-clamping device for an apron board configured in a single row according to an embodiment of the present disclosure. In the embodiment shown in the figure, the end cover 30 is mainly composed of two parts: a body 32 of the end cover and a tongue-shaped member 34 of the end cover, wherein the body 32 and the tongue-shaped member 34 are preferably made up of a transparent or translucent material, such as made of transparent plastic. Preferably, the tongue-shaped member 34 is formed on one end of the body 32, for example, on a first end, as shown in FIG. 4. Those skilled in the art can be aware of that, the tongue-shaped member 34 may also be located at other locations of the body 32, such as the central part of the body.

Figure 1:
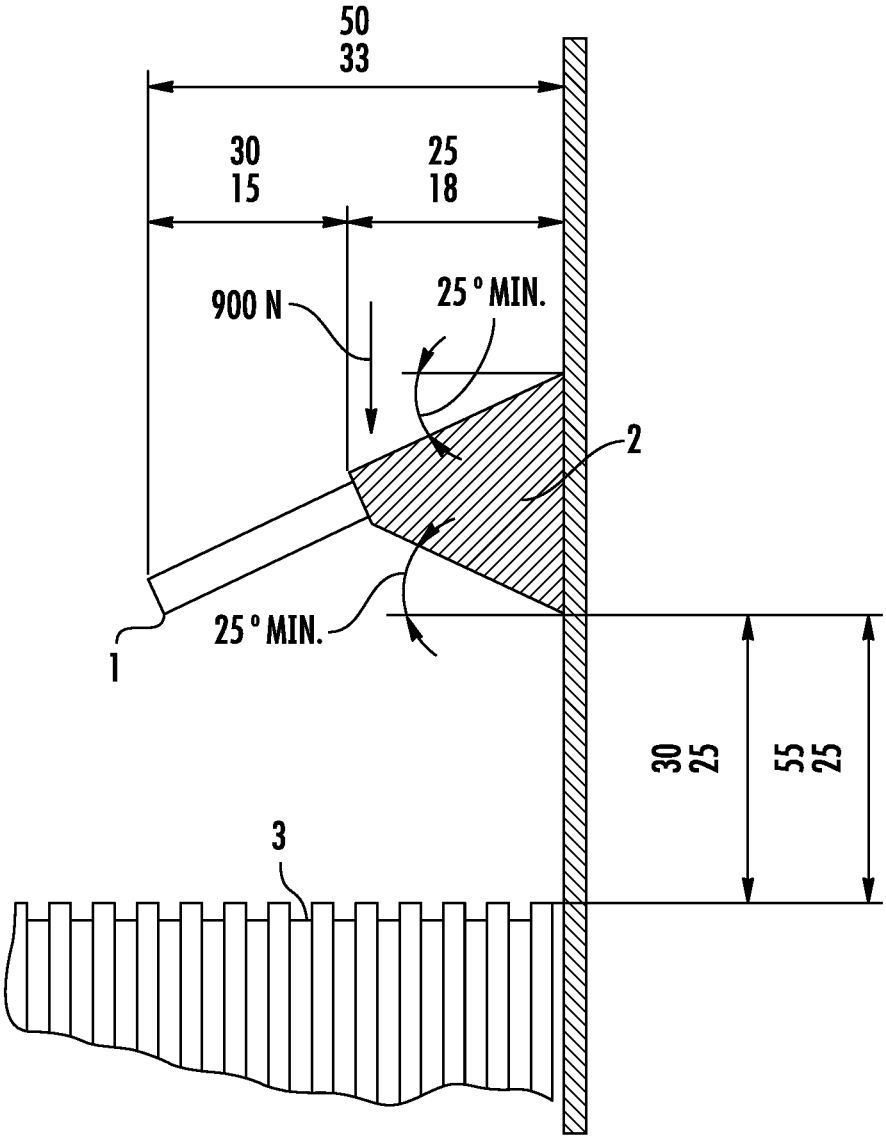
FIG. 1 PRIOR ART
FIG. 1 is a schematic view, which illustrates an anti-clamping device for an apron board and the relationship thereof with a step component in the prior art.
Figure 2:
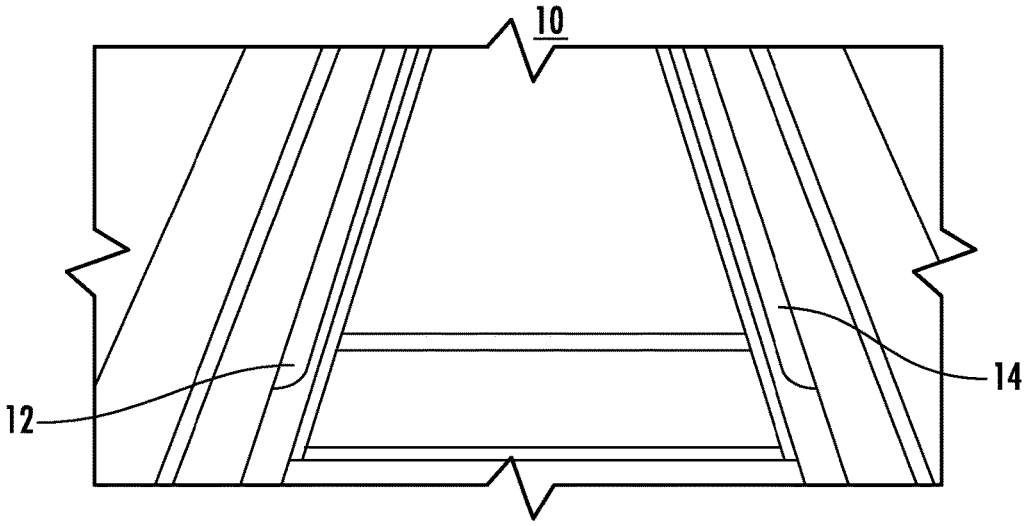
FIG. 2 PRIOR ART
FIG. 2 is a schematic view of a combination of an end cover and the anti-clamping device for an apron board according to the prior art.
Figure 3:
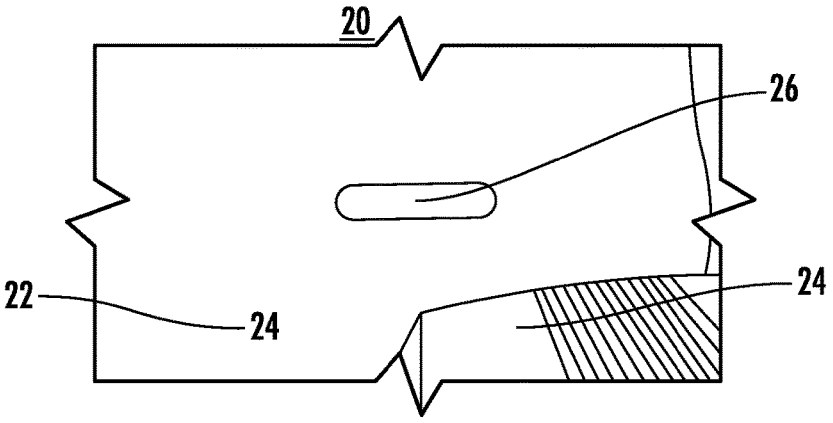
FIG. 3 PRIOR ART
FIG. 3 is a schematic view of illuminating the boundary between a comb and a step according to the prior art.

In accordance with an embodiment, one or multiple LED lighting lamp(s) 36 are provided in the interior of the body 32, the light of the LED lamp 36 may penetrate the body 32 to illuminate for example a boundary between a comb and a step (the position of the boundary may be known by referring to the boundary between the step 22 and the comb 24 in FIG. 3). Although a certain number of LED lamps are shown in the figure, which are linearly ordered in the substantially central part of the body 32, a larger or smaller number of LED lamps may also be used as needed, which are arranged at any appropriate locations of the body, for example, some LED lamps may be located on the inner surface of the body to enhance lighting. According to a preferred embodiment, the multiple LED lamps are of different colors, to play as a role of further warning. According to another preferred embodiment, the multiple LED lamps of different colors are placed at a certain interval, and the multiple LED lighting lamps flash alternately during the operation for further warning the users.

In accordance with an embodiment, through the cooperation between the tongue-shaped member 34 and at least a part of the anti-clamping device for an apron board in the prior art (see FIG. 6), the end cover 30 can be coupled (for example, be inserted) to one end of the anti-clamping device to form a detachable connection. In addition, the detachable connection can also be implemented in other manners, such as an interference fit connection, a buckling connection, and a bonding connection, to further increase the firmness of the connection between the end cover and the anti-clamping device.

More preferably, the detachable connection is formed on the above-mentioned first end of the body, and the size of the body 32 from the first end to the opposite second end is gradually reduced, so that the end cover can be used as a transition between the apron board and the anti-clamping device (not shown).

According to an embodiment, the body 32 and the tongue-shaped member 34 are formed integrally; and according to another embodiment, the body 32 and the tongue-shaped member 34 are manufactured separately and are connected by means of bonding.

According to an embodiment, as show in FIG. 4B, a through hole or a half-through hole is arranged at the central or other locations of the body 32, and a fastener is inserted into the through hole or the half-through hole to better fix the end cover 30 to the anti-clamping device that is not shown. In addition, the skilled persons can be aware of, a boss, a thread, or other structures in the through hole or the half-through hole, which cooperate with the fastener such as a bolt and a screw, can be arranged to play a better role in locating and fixing.

Preferably, after the installation of the end cover and the apron board protection device is complete, the distance between the end cover and the boundary from the comb to the step is between 50-150 mm, preferably between 60-120 mm, and more preferably 100 mm.

Persons skilled in the art can be aware of that, the shape and material of the above body 32 and the tongue-shaped member 34 are merely illustrative, which may be of any shape and made of any appropriate material that can realize the functions described in this disclosure, for example, the body 32 can accommodate any appropriate number of LED lamps 36 and is transparent, the tongue-shaped member 34 is capable of detachably connecting/coupling with the anti-clamping device for an apron board in the prior art, and so on.

Figure 5A:
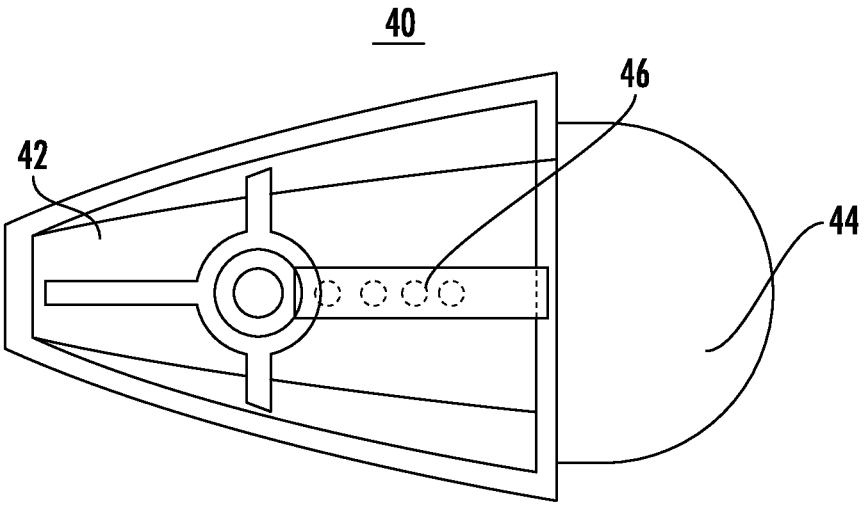
FIGS. 5A-5B are schematic views of the end cover for an anti-clamping device for an apron board configured in double rows according to an embodiment of the present disclosure.
Figure 5B:
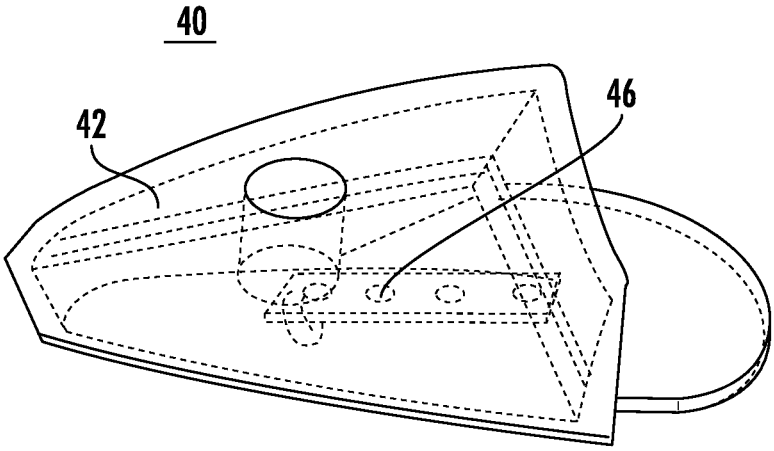

FIGS. 5A-5B are schematic views of the end cover 40 for the anti-clamping device for an apron board configured in double rows according to another embodiment of the present disclosure. In the embodiment shown in FIG. 5, the principle for arranging the body 42, the tongue-shaped member 44, and the LED lamp 46 is substantially the same as that for arranging the end cover shown in FIG. 4, and the difference thereof merely lies in that the embodiment of FIG. 5 is applicable to the anti-clamping device for an apron board configured in double rows, while the embodiment in FIG. 4 is applicable to the anti-clamping device for an apron board configured in a single row. Both the anti-clamping devices for an apron board configured in a single row and in double rows are familiar to persons skilled in the art, and persons skilled in the art, by reading the present invention, can understand how to use the corresponding anti-clamping device to cooperate with the end cover 30 or 40 of the present application, and are able to understand that the discussion and explanation about FIGS. 4A-4B in this disclosure are also applicable to FIG. 5A-5B correspondingly.

Figure 6:
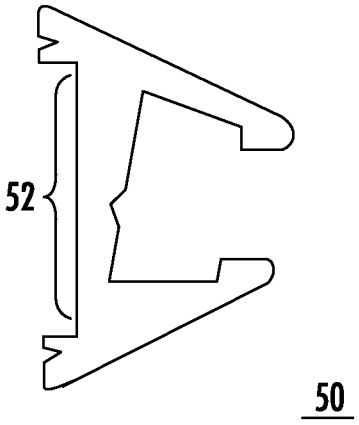
FIG. 6 is a schematic view of a cross section of a rigid member of the anti-clamping device cooperated with the end cover in the embodiment of the present disclosure.

FIG. 6 is a schematic view of a cross section of a rigid member 50 of the anti-clamping device cooperated with the end cover in the embodiment of the present disclosure. As described above, the tongue-shaped member 34 of the end cover can cooperate therewith to form a detachable connection. In the embodiment of FIG. 6, the tongue-shaped member 34 is applicable to be inserted into a groove 52, so that the end cover is "installed" on one end of the anti-clamping device.

Persons skilled in the art can understand that, the specific connection manner between the anti-clamping device and the end cover in the embodiment in this disclosure may differ according to different end covers, so that the detachable connection finally formed between the anti-clamping device and the end cover includes one or more of a plug-in connection, an interference fit connection, a buckling connection, and a bonding connection.

According to the further embodiment of this disclosure, in order to supply power to electronic devices (for example, LED lamps 36 and 46) in the bodies 32 and 42, any existing or future developed manners may be adopted to establish an electrical coupling between the end cover and the anti-clamping device. For example, a wired cable is adopted to connect the anti-clamping device and the end cover, to supply power. For another example, the electrical coupling is established in a wireless manner between the anti-clamping device and the end cover (at this time, a wireless transmit/receive unit may be additionally provided between the anti-clamping device and the end cover) to supply power. In a word, the wired and wireless power supply manners that are well known in the art and developed in the future may be used as the electrical coupling manner between the end cover and the anti-clamping device according to the requirements of actual situations.

Therefore, persons skilled in the art will also be aware of that, the "coupling" and "connection" mentioned in the specification and claims not only include various mechanical couplings/connections specifically described above, but also include a wired or wireless electrical coupling. That is to say, the terms "coupling" and "connection" ever mentioned in this disclosure should be understood in the most general way according to the context, rather than being explained in a narrow sense.

Persons skilled in the art can further understand that, the features of different embodiments can be used in combination, and all the technical features of the same embodiment are not necessarily reflected entirely in a specific implementation. For example, although the holes can be drilled in the bodies 32 and 42 to promote the fixing between the body and the protection device, in order to save cost and/or meet the requirements such as standardization, it is completely possible to drill no hole or drill one or multiple holes strictly according to the standard size and location. For another example, although the end cover is preferably a plastic material, but any other transparent/translucent material that can meet the safety standards in terms of hardness or the like can also be used.

To sum up, the present written description uses examples to disclose the present invention including an optimal mode, and enables persons skilled in the art to practice the present invention, including the method for fabricating and using any device or system and executing any combination thereof. However, the patentable scope of the present invention can be defined by the claims, and may include other examples that can be thought of by persons skilled in the art.

LIST OF COMPONENTS

1 Flexible member
2 Rigid member
3 Step
12 End cover
14 Anti-clamping device for an apron board
22 Step
24 Comb
26 Comb lamp
30 Schematic view of the end cover
32 Body of the end cover
34 Tongue-shaped member of the end cover
36 LED lamp
40 Schematic view of the end cover
42 Body of the end cover
44 Tongue-shaped member of the end cover
46 LED lamp
50 Schematic view
52 Groove in which the end cover can be inserted

The invention claimed is:

1. An end cover of an anti-clamping device for an apron board, comprising:

a body made entirely of a transparent material or a translucent material, one or multiple LED lighting lamp(s) provided in the interior of the body; and a coupling member formed on at least a part of the transparent or translucent body, which cooperates with at least a part of the anti-clamping device to form a detachable connection between the body and the anti-clamping device, wherein, the size from a first end of the transparent or translucent body to a second end of the transparent or translucent body is gradually reduced so as to form a smooth transition between the apron board and the anti-clamping device.

2. The end cover according to claim 1, wherein the coupling member is connected to the at least a part of the anti-clamping device through one of a plug-in connection, a buckling connection, an interference fit connection, and a bonding connection.

3. The end cover according to claim 2, wherein the one or multiple LED lighting lamps are placed on at least one of a support in the interior of the body or an inner surface of the body.

4. The end cover according to claim 3, wherein the multiple LED lighting lamps are of different colors.

5. The end cover according to claim 4, wherein the multiple LED lighting lamps are placed in a certain interval, and the multiple LED lighting lamps flash alternately during operation.

6. The end cover according to claim 1, further comprising a through hole or a half through hole located in the central part of the body, for accommodating a fastener for further fixing the end cover and the anti-clamping device.

7. The end cover according to claim 1, wherein a distance between the end cover and a corresponding step-comb intersection line is between 50-150 mm.

8. The end cover according to claim 1, wherein the anti-clamping device comprises any one of a single-row anti-clamping device and a double-row anti-clamping device.

9. An escalator system, comprising the end cover of an anti-clamping device for an apron board according to claim 1.

10. A travelator system, comprising the end cover of an anti-clamping device for an apron board according to claim 1.

11. An end cover of an anti-clamping device for an apron board, comprising:

a body made entirely of a transparent material or a translucent material, one or multiple LED lighting lamp(s) provided in the interior of the body; and a coupling member formed on at least a part of the transparent or translucent body, which cooperates with at least a part of the anti-clamping device to form a detachable connection between the body and the anti-clamping device;

a through hole or a half through hole located in the central part of the body, for accommodating a fastener for further fixing the end cover and the anti-clamping device;

wherein, the size from a first end of the transparent or translucent body to a second end of the transparent or translucent body is gradually reduced so as to form a smooth transition between the apron board and the anti-clamping device;

wherein the coupling member is connected to the at least a part of the anti-clamping device by at least one of a plug-in connection, a buckling connection, an interference fit connection, and a bonding connection;

wherein the one or multiple LED lighting lamps are placed on at least one of a support in the interior of the body or an inner surface of the body;

wherein the one or multiple LED lighting lamps are of different colors;

wherein the one or multiple LED lighting lamps are placed in a certain interval, and the one or multiple LED lighting lamps flash alternately during operation;

wherein a distance between the end cover and a corresponding step-comb intersection line is between 50-150 mm;

wherein the anti-clamping device comprises one of a single-row anti-clamping device and a double-row anti-clamping device.

* * * * *